US005125203A

United States Patent [19]

Daw

[11] Patent Number: 5,125,203

[45] Date of Patent: Jun. 30, 1992

[54] FLOAATING CONNECTOR SYSTEM BETWEEN CEILING AND WALL STRUCTURE

[75] Inventor: Terry L. Daw, Murray, Utah

[73] Assignee: Daw Technologies, Inc., Salt Lake City, Utah

[21] Appl. No.: 331,826

[22] Filed: Apr. 3, 1989

[51] Int. Cl.[5] ..... E04B 2/82; E04B 9/00

[52] U.S. Cl. ..... 52/241; 52/488

[58] Field of Search ..... 52/241, 242, 484, 488

[56] References Cited

U.S. PATENT DOCUMENTS

| | | | |
|---|---|---|---|
| 3,309,826 | 3/1967 | Zinn | 52/241 |
| 3,315,424 | 4/1967 | Smith | 52/488 |
| 3,453,790 | 7/1969 | Harris | 52/241 |
| 3,593,475 | 7/1971 | La Gue | 52/241 |
| 3,861,103 | 1/1975 | Rasmussen | 52/241 |
| 3,956,861 | 5/1976 | Rasmussen | 52/241 |

FOREIGN PATENT DOCUMENTS

| | | | |
|---|---|---|---|
| 2238020 | 3/1975 | France | 52/241 |

*Primary Examiner*—Michael Safavi

*Attorney, Agent, or Firm*—Thorpe, North & Western

[57] ABSTRACT

A floating connector system is provided for airtight sealing between a ceiling structure and a wall structure. The connector system comprises an elongate channel member which has a generally U-shaped cross section. The elongate channel member is attached to the ceiling structure such that the elongate channel member is supported by the ceiling structure and forms a continuous, airtight seal with the ceiling structure. An elongate cap member is attached to the wall structure to form the top edge of the wall structure. The cap member is received within the elongate channel member, with the sides of the cap member being spaced in flatwise orientation from the sides of said channel member. A pair of elongate, elastomeric seal members are positioned between the respective sides of the cap member and the channel member. The seal members make an airtight seal between the cap member and the channel member, and the cap member and associated wall structure are effectively isolated from transmission of vibration from the ceiling structure.

17 Claims, 2 Drawing Sheets

FLOAATING CONNECTOR SYSTEM BETWEEN CEILING AND WALL STRUCTURE

BACKGROUND OF THE INVENTION

1. Field of the Invention

The present invention relates to a floating connector system which seals a wall structure to a ceiling structure while simultaneously isolating the wall structure from transmission of vibration from the ceiling structure. The connector system is ideally suited in industrial structures which are to meet cleanroom specifications such as are required for the production of integrated circuit chips, electronic components and other products which are subject to contamination from airborne microcontamination as well as to defects which can be caused by inadvertent movement during formation of the microcircuitry on the chips.

2. Prior Art

The advance of modern technology into the world of miniaturization has necessitated the development of unique manufacturing environments. For example, the preparation of multilayered, integrated computer chips includes the fabrication of wafer masks and layouts that include hundreds of tiny circuits whose operational condition depends upon the absence of foreign materials and very accurate placement of circuit components on the chips. These chips are prepared in an industrial cleanroom which is classified based upon the amount of microcontamination within the room.

Examples of such cleanrooms are shown in my earlier U.S. Pat. No. 4,667,579, issued May 26, 1987 and the related art mentioned in that patent.

Because of the microminiaturation involved in manufacturing integrated electronic wafers or chips, there has been, in addition to maintaining an ultra-clean environment, an additional problem associated with the control of vibrational movements occurring in the equipment used in manufacturing the wafers or chips. The equipment is supported upon flooring and walls of the cleanroom, and although it is within the skill of the art to substantially isolate flooring and walls from building vibrations, it has been a problem to isolate walls and flooring from vibrations emanating from the roof or ceiling structure of the building. The undesirable vibration can substantially effect the quality of subminiature wafers or chips being made.

3. Objectives

A principal objective of the invention is to provide a novel, floating connector system for airtight sealing between a ceiling structure and a wall structure, wherein the connector system further substantially isolates the wall structure from transmission of vibrations from the ceiling structure.

A particular objective of the present invention is to provide such a floating connector system for airtight sealing between the ceiling structure and the wall structure of an industrial cleanroom enclosure.

BRIEF DESCRIPTION OF THE INVENTION

The above objectives are achieved in accordance with the present invention by providing a novel, floating connector system which provides airtight sealing between a ceiling structure and a wall structure and, in addition, provides substantial isolation of the wall structure from transmission of vibrations from the ceiling structure. The novel system comprises an elongate channel member which has a generally U-shaped cross section, with two substantially parallel, spaced sides extending from a base section. The base section of the channel member is attached to the ceiling structure such that the channel member is supported by and forms a continuous, airtight seal with the ceiling structure. The spaced sides of the elongate channel extend downwardly from the base section.

The top edge portion of the wall structure is formed by an elongate cap member which is attached along the upper side of the main wall panels of the wall structure. The cap member has two substantially parallel spaced side plates and a base plate which interconnects the upper edges of the side plates. The side plates of the cap member extend downward along the opposite, side faces of the side wall panels of the wall structure, such that the side plates of the cap member form the top side edges of the wall structure. The base plate of the cap member forms the closed, top end of the wall structure.

The base plate and at least a portion of the spaced side plates of the cap member are received within the elongate channel member, with the spaced side plates of the cap member being spaced in flatwise orientation from the spaced sides of the channel member, such that the upper portion of the cap member is free to move up and down relative to the channel member. The floating, free movement of the cap member within the channel member effectively isolates the wall structure from transmission of vibration from the ceiling.

To provide means for an airtight seal between the wall and the ceiling structure, a pair of elongate, elastomeric seal members are positioned between the respective spaced side plates of the cap member and the spaced sides of the channel member. The seal members extend along the full length of the wall and form an effective airtight seal between the cap member of the wall structure and the channel member attached to the ceiling structure. The seal members do not transmit vibration from the ceiling structure but do provide an effective, airtight seal between the wall structure and the ceiling structure.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which:

FIG. 1 is a vertical cross section through the juncture of a wall and ceiling structure showing one preferred embodiment of the floating connector system of the present invention; and FIG. 2 is cross section similar to that of FIG. 1 but shows a second preferred embodiment of the floating connector system of the present invention.

DETAILED DESCRIPTION OF THE PREFERRED EMBODIMENTS

Figure 1:
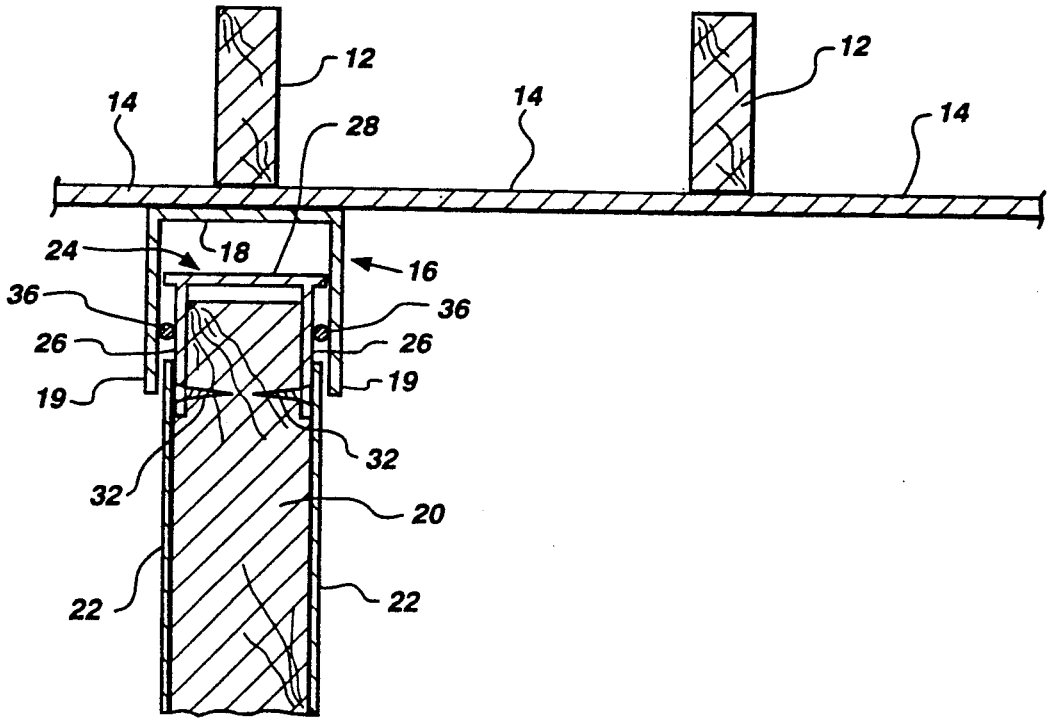

Referring now to FIG. 1 of the drawings, there is shown one preferred embodiment of a system in accordance with the present invention for airtight sealing of wall structure and associated ceiling structure. As illustrated in FIG. 1, the ceiling structure can be of conventional construction wherein ceiling joists 12 support ceiling panelling 14. The ceiling panelling 14, as is well known, can be formed of numerous panels which are sealed together at abutting joints such that air cannot pass through or infiltrate into the cleanroom enclosure through the ceiling panelling 14.

In accordance with the present invention, a novel, floating connector system is provided for airtight sealing between the wall and ceiling structure. The connector system comprises an elongate channel member 16 which has a generally U-shaped cross section. The base member 18 of the channel member 16 is firmly attached to the ceiling structure such that the elongate channel member 16 is supported by the ceiling structure and forms a continuous, airtight seal with the ceiling structure. To that end, the base member 18 of the channel member 16 is attached firmly to the panelling 16 of the ceiling structure. The spaced sides 19 of the channel member 16 extend downwardly in substantially parallel configuration from the base section.

The wall structure can be of any conventional design. The wall structure may comprise spaced, vertical frame members 20 to which external wall panels 22 are attached. As shown in FIG. 1, the frame members 20 extend upwardly beyond the upper edges of the wall panels 22 by a small distance of generally at least about 1 inch and no greater than about 2 or 3 inches. An elongate cap member 24 is firmly attached to the upper edge of the wall structure. The elongate cap member 24 has two substantially parallel spaced side plates 26 and a base plate 28 which interconnects the upper edges of the side plates 26. The elongate cap member 24 is attached to the wall structure with the spaced side plates 26 forming the top side edges of the wall structure, and with the base plate 28 forming the closed, top end of the wall structure.

As illustrated, the downwardly extending side plates 26 of the cap member 24 fit over the upper extending ends of the wall frame members 20 and between the wall frame members 20 and the respective wall panelling 22. An airtight seal is formed between the upper ends of the wall panelling 22 and the downwardly extending side plates 26 of the cap member 24. An adhesive can be used to secure the upper ends of the wall panelling 22 to the side plates 26 and to the wall frame members 20. Mechanical attachment means, such as countersunk screws 32, can be used in place of or in addition to the adhesive to secure the cap member 24 to the upper ends of the wall frame members 20.

The base plate portion 28 of cap member 24 and at least a portion of the spaced side plates 26 are received within the elongate channel member 16, with the spaced side plates 26 of the cap member 24 being spaced in flatwise orientation from the spaced sides of the channel member 16. This allows relative up and down movement of the wall structure, including the cap member 24, relative to the ceiling structure, including the channel member 16.

To achieve an airtight seal between the wall structure and the ceiling structure, a pair of elongate, elastomeric seal members 36 are positioned between the respective spaced side plates 26 of the cap member 24 and the spaced sides 19 of the channel member 16. The seal members 36 make an airtight seal between the cap member 24 and the channel member 16 while allowing relative up and down movement of the cap member 24 relative to the channel member 16 to effectively isolate the cap member 24 and its associated wall structure from transmission of vibration from the ceiling structure.

As illustrated, the elongate, elastomeric seal members 36 preferably have a transverse cross section which is circular in shape. The seal members 36 are advantageously positioned within an elongate channel formed in part by ends of the base plate 28 which extend beyond the spaced side plates 26 of the cap member 24 to form elongate flanges along the top of the wall structure. The remaining portion of the channel in which the seal member 36 is positioned is formed by the respective spaced side plates 26 and respective sides 19 ends of the channel members 16.

Figure 2:
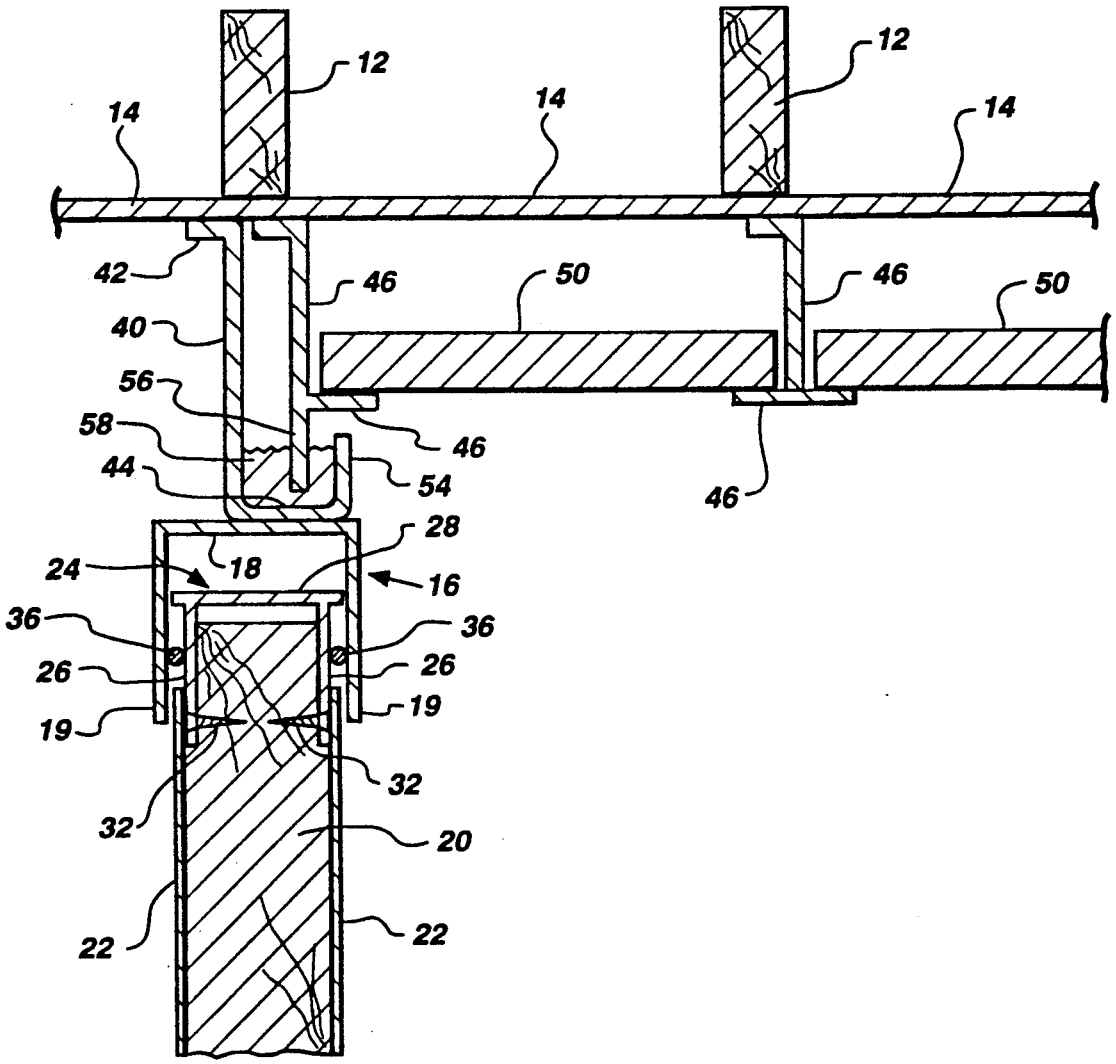

Referring now to FIG. 2 of the drawings, there is shown a second preferred embodiment of the floating connector system of the present invention. The illustrated second embodiment is particularly advantageous for airtight sealing between the ceiling structure and the wall structure of an industrial cleanroom enclosure used in manufacturing electronic chips containing micro-circuitry. As explained in my previous U.S. Pat. No. 4,667,579, it is advantageous to provide a subceiling comprising filter elements spaced downwardly from the panelling 14 forming the upper ceiling of the cleanroom enclosure. This forms a plenum above the subceiling or filter elements, and as explained fully in U.S. Pat. No. 4,667,579, a flow of air can be provided to the plenum, with the air passing through the filter elements to the cleanroom enclosure. For further details relating to the air plenum and the supply of air to the air plenum, one is referred to my previous U.S. Pat. No. 4,667,579.

As illustrated in FIG. 2, the connector system comprises an elongate channel member 16 similar to that previously described with respect to the system shown in FIG. 1. The channel member 16 has a base portion 18 and spaced sides 19, and the channel member 16 is attached to the ceiling structure in a manner similar to that previously described in reference to the system shown in FIG. 1. The base section 18 is located adjacent to the ceiling structure, and the spaced sides 19 of the channel member 16 extend downwardly from the base section 18 and the ceiling panelling 14.

In the embodiment shown in FIG. 2, the means for attaching the elongate channel member 16 to the ceiling structure comprises an elongate hanger 40. The hanger 40 has upper and lower longitudinal sides, and as illustrated in FIG. 2, these sides take the form of flanges 42 and 44 respectively. The hanger 40 has a longitudinal length at least that of the respective longitudinal dimension of the elongate channel member 16.

The elongate hanger 40 is attached along its upper longitudinal side to the ceiling panelling 14, with an airtight seal being formed between the elongate hanger 40 and the ceiling panelling 14. The elongate channel member 16 is attached to the lower, longitudinal side of the elongate hanger 40, with an airtight seal being formed between the elongate channel member 16 and the elongate hanger 40.

An elongate cap member 24 is provided, and the cap member 24 and its associated wall structure are similar to the cap member 24 and wall structure shown in FIG. 1. The elements of the cap member 24 and wall structure are shown in FIG. 2 with the same reference numerals as shown in FIG. 1. The cap member 24 and upper end of the wall structure are received in the channel member 16 as previously described with reference to the system of FIG. 1, and seal members 36, as previously described, are used to seal the cap member 24 airtight with respect to the channel member 16.

A support grid 46 is suspended from the ceiling panelling 14 at a position above the lower side of the elongate hanger 40, and ceiling filter members 50 are supported by the support grid 46 to form a plenum between the ceiling filter members 50 and the ceiling panelling 16. Means are provided for sealing the periphery of the support grid 46 to the elongate hanger 40 together with additional means for sealing the periphery of each filter member 50 to the support grid 46 such that passage of air from the plenum into the cleanroom enclosure is through the filter members 50.

As illustrated in FIG. 2, the means for sealing the periphery of the support grid 46 to the elongate hanger 40 comprises an upwardly opening trough extending along the lower side of the elongate hanger 40. The trough is formed by a ledge 54 extending upwardly from the end of the flange 44. A downwardly extending flange 56 is provided at the periphery of the support grid 46, with the downwardly extending flange 56 projecting into the upwardly opening trough of the elongate hanger 40. A seal material 58 is formed in the upwardly opening trough to make an airtight seal between the upwardly opening trough and the flange 56 on the support grid 46. The seal material preferably comprises a resilient, dielectric material.

Although preferred embodiments of the floating connector system of the present invention have been illustrated and described, it is to be understood that the present disclosure is made by way of example and that various other embodiments are possible without departing from the subject matter coming within the scope of the following claims, which subject matter is regarded as the invention.

I claim:

1. A floating connector system for airtight sealing between a ceiling structure and a wall structure, said system comprising an elongate channel member having a generally U-shaped cross section, said channel member comprising two substantially parallel, spaced sides extending from a base section;

means for attaching the elongate channel member to the ceiling structure such that said elongate channel member is supported by the ceiling structure and forms a continuous, airtight seal with the ceiling structure, with the base section of said elongate channel member being located adjacent to the ceiling structure and with the spaced sides of said elongate channel member extending downwardly from the base section;

an elongate cap member having two substantially parallel spaced side plates and a base plate which interconnects the upper edges of said side plates, said base plate extending at its opposing edges laterally beyond the respective side plates, but having a width less than the interior width of the channel member, thereby enabling free, uninhibited vertical movement of the elongate cap member within the channel member;

means for attaching the elongate cap member to the wall structure such that said spaced side plates form the top side edges of said wall structure and said base plate forms the top end of said wall structure;

said base plate and at least a portion of said spaced side plates of said elongate cap member being received within said elongate channel member, with said spaced side plates of said cap member being spaced in flatwise orientation from said spaced sides of said channel member; and a pair of elongate, elastomeric seal members positioned between the respective spaced side plates of said cap member and said spaced sides of said channel member, whereby said seal members make an airtight seal between said cap member and said channel member and whereby said seal members further isolate said cap member and its associated wall structure from transmission of vibration from said ceiling structure;

said seal members being partially retained between the respective side plates of the cap member and spaced sides of the channel member by the extending edges of the cap base plate which block escape of the elastomeric seal members.

2. A floating connector system in accordance with claim 1, wherein the elongate, elastomeric seal members have a transverse cross section which is circular in shape.

3. A floating connector system in accordance with claim 1, wherein the wall structure comprises spaced, vertical frame members whose upper ends are received within the space between the spaced side plates of said cap member;

the means for attaching the elongate cap member to the wall structure comprises attachment means which secures the spaced side plates of said cap member to respective sides of the ends of said frame members which are received between said side plates of said cap member; and said wall structure further comprises wall panels attached to the frame members, with the upper edges of said wall panels overlapping the bottom edges of said spaced side plates of said cap member.

4. A floating connector system in accordance with claim 3, wherein the elongate, elastomeric seal members have a transverse cross section which is circular in shape.

5. A floating connector system in accordance with claim 4, wherein said base plate of said cap member extends beyond the spaced side plates of said cap member to form opposite flanges at the top of said wall structure, with the flanges, the mutually respective side plates of said cap member and the mutually respective upper edges of said wall panels forming an elongate channel in which the elongate, elastomeric seal members are positioned.

6. A floating connector system in accordance with claim 3, wherein the upper edges of said wall panels which overlap said spaced side plates of said cap member are sealed airtight to the overlapped portions of said spaced side plates.

7. A floating connector system for airtight sealing between ceiling structure and wall structure of an industrial cleanroom enclosure, said connector system comprising an elongate channel member having a generally U-shaped cross section, said channel member comprising two substantially parallel, spaced sides extending from a base section;

means for attaching the elongate channel member to the ceiling structure such that said elongate channel member is supported by the ceiling structure and forms a continuous, airtight seal with the ceiling structure, with the base section of said elongate channel member being located adjacent to the ceiling structure and with the spaced sides of said elongate channel member extending downwardly from the base section;

an elongate cap member having two substantially parallel spaced side plates and a base plate which interconnects the upper edges of said side plates, aid base plate having a shorter width than the interior width of the channel member;

means for attaching the elongate cap member to the wall structure such that said spaced side plates form the top side edges of said wall structure and said base plate forms the top end of said wall structure;

said base plate and at least a portion of said spaced side plates of said elongate cap member being received within said elongate channel member, with said spaced side plates of said cap member being spaced in flatwise orientation from said spaced sides of said channel member; and a pair of elongate, elastomeric seal members positioned between the respective spaced side plates of said cap member and said spaced sides of said channel member, whereby said seal members make an airtight seal between said cap member and said channel member and whereby said seal members further isolate said cap member and its associated wall structure from direct contact with and transmission of substantial vibration from said channel member and attached ceiling structure.

8. A floating connector system in accordance with claim 7, wherein the elongate, elastomeric seal members have a transverse cross section which is circular in shape.

9. A floating connector system in accordance with claim 7, wherein the wall structure comprises spaced, vertical frame members whose upper ends are received within the space between the spaced side plates of said cap member;

the means for attaching the elongate cap member to the wall structure comprises attachment means which secures the spaced side plates of said cap member to respective sides of the ends of said frame members which are received between said side plates of said cap member; and said wall structure further comprises wall panels attached to the frame members, with the upper edges of said wall panels overlapping the bottom edges of said spaced side plates of said cap member.

10. A floating connector system in accordance with claim 9, wherein the elongate, elastomeric seal members have a transverse cross section which is circular in shape.

11. A floating connector system in accordance with claim 10, wherein said base plate of said cap member extends beyond the spaced side plates of said cap member to form opposite flanges at the top of said wall structure, with the flanges, the mutually respective side plates of said cap member and the mutually respective upper edges of said wall panels forming an elongate channel in which the elongate, elastomeric seal members are positioned.

12. A floating connector system in accordance with claim 9, wherein the upper edges of said wall panels which overlap said spaced side plates of said cap member are sealed airtight to the overlapped portions of said spaced side plates.

13. A floating connector system in accordance with claim 7, wherein said ceiling structure comprises a support structure and an upper ceiling panel supported by said support structure.

14. A floating connector system in accordance with claim 13, wherein the means for attaching the elongate channel member to the ceiling panel comprises an elongate hanger having upper and lower longitudinal sides and a longitudinal length at least that of the respective longitudinal dimension of the elongate channel member;

said elongate hanger is attached along its upper longitudinal side to said ceiling panel with an airtight seal being formed between said elongate hanger and said ceiling panel; and said elongate channel member is attached to the lower, longitudinal side of said elongate hanger, with an airtight seal being formed between said elongate channel member and said elongate hanger.

15. A floating connector system in accordance with claim 14, wherein a support grid is suspended from said ceiling panel at a position above the lower side of said elongate hanger;

ceiling filter members are supported by said support grid to form a plenum between the ceiling filter members and the ceiling panel; and means are provided for sealing the periphery of said support grid to said elongate hanger together with additional means for sealing the periphery of each filter member to said support grid such that passage of air from said plenum into said cleanroom enclosure is through said filter members.

16. A floating connector system in accordance with claim 15, wherein said means for sealing the periphery of said support grid to said elongate hanger comprises an upwardly opening trough extending along the lower side of said elongate hanger;

a downwardly extending flange at the periphery of said support grid, with the downwardly extending flange projecting into said upwardly opening trough of said elongate hanger; and a seal material formed in said upwardly opening trough to make an airtight seal between the upwardly opening trough and the flange on the support grid.

17. A floating connector system in accordance with claim 16, wherein said seal material comprises a resilient, dielectric material.

* * * * *